United States Patent [19]

Ito

[11] 4,317,016

[45] Feb. 23, 1982

[54] INDUCTION HEATING COOKING APPARATUS

[75] Inventor: Susumu Ito, Fuji, Japan

[73] Assignee: Tokyo Shibaura Denki Kabushiki Kaisha, Kawasaki, Japan

[21] Appl. No.: 217,442

[22] Filed: Dec. 17, 1980

[30] Foreign Application Priority Data

Dec. 27, 1979 [JP] Japan ..... 54-171681

[51] Int. Cl.[3] ..... H05B 5/04

[52] U.S. Cl. ..... 219/10.49 R; 219/10.77; 219/10.79; 335/205

[58] Field of Search ..... 219/10.49, 10.67, 10.75, 219/10.79, 10.77, 518, 519; 126/395, 211; 336/DIG. 2; 338/12; 226/163; 335/205, 219, 286; 318/128

[56] References Cited

U.S. PATENT DOCUMENTS

| | | | |
|---|---|---|---|
| 3,711,672 | 1/1973 | Moreland et al. | 219/10.49 |
| 3,742,174 | 6/1973 | Harnden, Jr. | 219/10.49 |
| 3,742,179 | 6/1973 | Harnden, Jr. | 219/10.77 |
| 3,761,667 | 9/1973 | Walden | 219/10.49 |
| 3,775,577 | 11/1973 | Peters, Jr. | 219/10.49 |
| 3,796,850 | 3/1974 | Moreland et al. | 219/10.49 |
| 3,814,888 | 6/1974 | Bowers et al. | 219/10.49 |
| 3,852,558 | 12/1974 | McCleerey et al. | 219/10.49 |

FOREIGN PATENT DOCUMENTS 48-81145 1/1973 Japan .

*Primary Examiner*—Volodymyr Y. Mayewsky
*Attorney, Agent, or Firm*—Cushman, Darby & Cushman

[57] ABSTRACT

A first portion of a top plate section of an induction heating cooking apparatus is used for placing a cooking pan thereon. A second portion of the same is used for controlling an output of an oscillation circuit for induction-heating the pan. The output control device includes a permanent magnet movably disposed along a groove provided in the surface of the second portion of the top plate section, a magnetic field adjusting plate provided on the inner surface of the second portion corresponding to the groove, a magnetic field detecting circuit including a Hall element provided close to one end of the magnetic field adjusting plate, and an oscillation output control circuit for controlling the output from the oscillation circuit by a control signal obtained by comparing the output signal from the magnetic field detecting circuit with a reference signal.

12 Claims, 28 Drawing Figures

FIG. 9
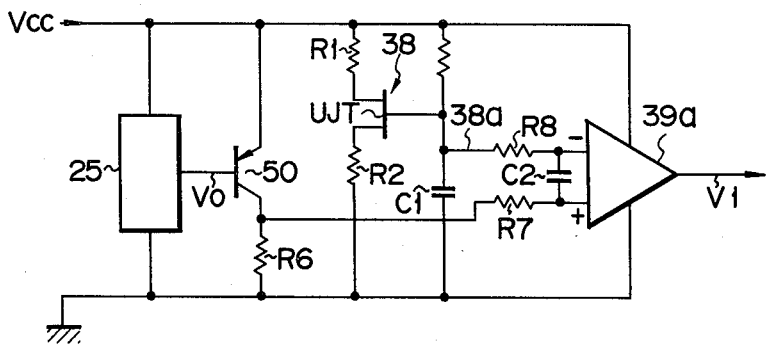
FIG. 10A
Vo: OUTPUT OF 25
FIG. 10B
38a: OUTPUT OF 47
FIG. 10C
OUTPUT OF TRANSISTOR 50
FIG. 10D
V1: OUTPUT OF 47
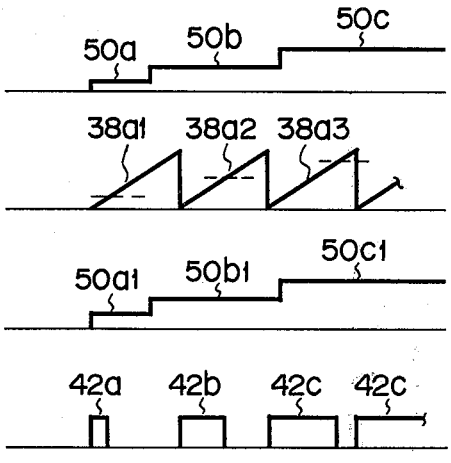

INDUCTION HEATING COOKING APPARATUS

The present invention relates to an induction heating cooking apparatus in which food stuffs in a cooking pan are cooked by induction-heating the pan with a high frequency magnetic field.

In the induction heating cooking apparatus of this type, a high frequency oscillator feeds a high frequency current into an induction heat coil which applies a high frequency magnetic field into the cooking pan. The resulting eddy currents induced in the cooking pan produce heat for cooking the food stuff. A typical induction heating cooking apparatus is provided with a housing with a top plate section and an oscillation section contained in the housing, which is connected to an external power source and has an induction heating coil for induction-heating the cooking pan, and an output control section for controlling the output of the oscillation section. The top plate section made of nonmagnetic material such as glass or aluminium includes a first portion on which the cooking pan is placed and a second portion to which parts for coupling the external power source to the oscillation section or parts for controlling the output of the oscillation section are mounted. The second portion will also be referred to a control panel. Conventionally, for turning on the external power source or controlling the output of the oscillation section by manipulating the parts, properly configured slits or holes must be formed in the control panel. The provision of the slits or holes allows water to enter the inside of the housing. This possibly causes the current leakage of the parts within the housing. To avoid this, a partitioning member must be provided between the first and second portions of the top plate section to prevent the water movement from the first portion to the second portion. Even the partitioning member is provided, the water entering from the slits or holes is not frequently prevented. For this reason, it is difficult to construct the first and second portions of the top plate section integrally with same material. This also prevents the easiness of assembling the cooking apparatus. As the parts for controlling the output of the oscillation section is mounted on the control panel so as not to easily detached, the clearing operation of the top plate section was also difficult.

An object of the invention is to provide an induction heating cooking apparatus in which a magnetic field generating element such as a permanent magnet is moved along the surface of a control panel as an output control knob, parts to be controlled are arranged on the inner side corresponding to the path of the movement of the knob, thereby control the electrical connection between a power source and an oscillation section of the heating cooking apparatus or control the output of the oscillation section.

The induction heating cooking apparatus of the present invention comprises a housing with a top plate section including a first nonmagnetic portion on which an induction heating pan is placed and a second nonmagnetic portion for controlling the induction heating of the cooking pan, a drive circuit with an oscillation circuit including an induction heating coil for heating the cooking pan, which is contained in the housing for being connected to an external power source, and oscillation output control means for controlling the oscillation output of the oscillation circuit. The oscillation output control means comprises a magnetic field generating element slidable along a guide path formed on the surface of the second portion of the top plate section, a magnetic field adjusting plate made of a magnetic material and provided on the inner side corresponding to the guide path of the second portion of the top plate section, a magnetic field detecting circuit which is provided close to a first end of the magnetic field adjusting plate and includes a semiconductor element for producing an output signal corresponding to an intensity of a magnetic field developed from the magnetic field generating element, and an oscillation output control circuit which compares the output signal from the magnetic field detecting circuit with a reference signal produced from a reference signal generating circuit.

Other objects and features of the present invention will be apparent from the following description taken in connection with the accompanying drawings, in which.

Figure 3:
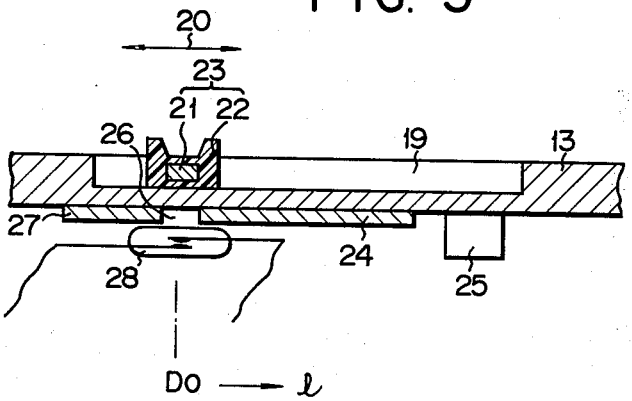
FIG. 3 shows an exploded view taken on line 3—3 in FIG. 1.
Figure 4:
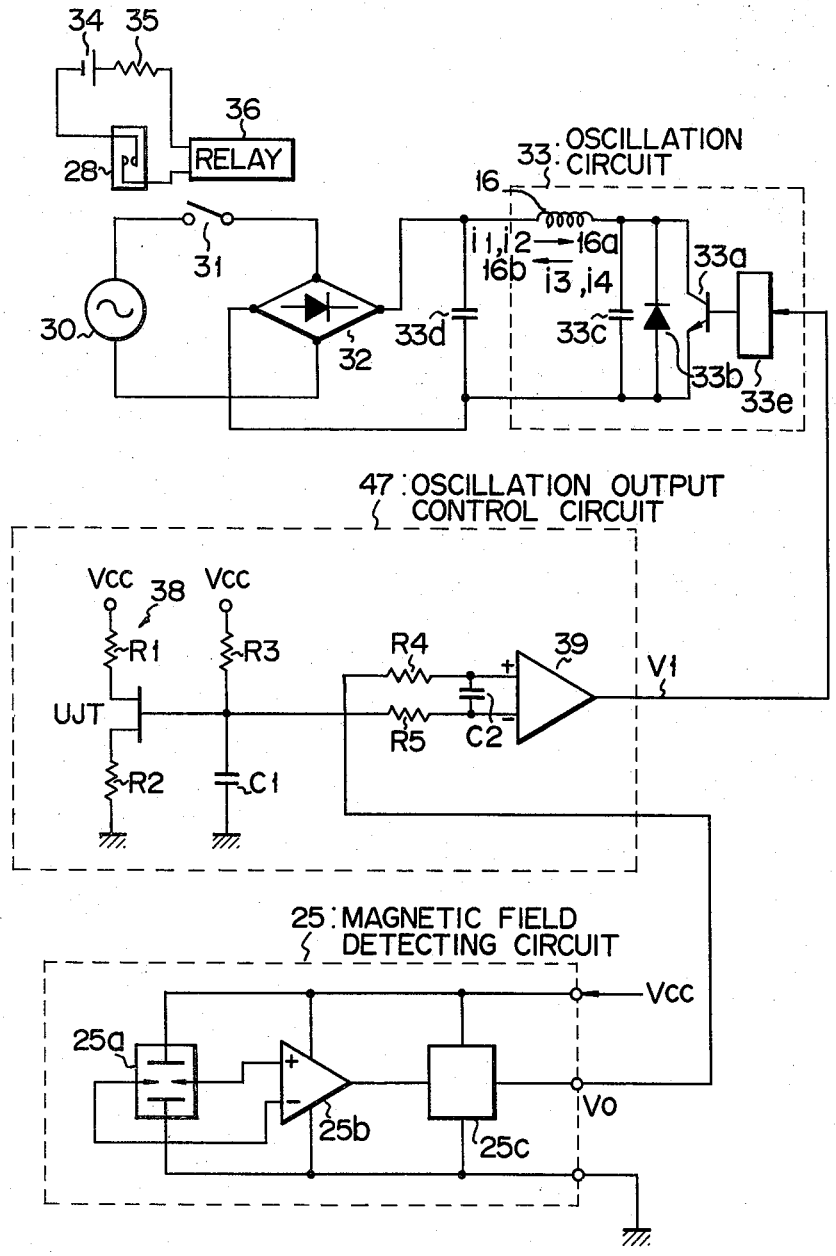
FIG. 4 is a circuit diagram of the cooking apparatus shown in FIG. 1.
Figure 5:
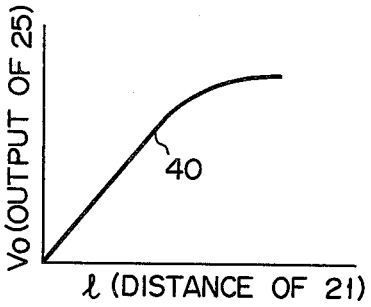
Figure 6A:
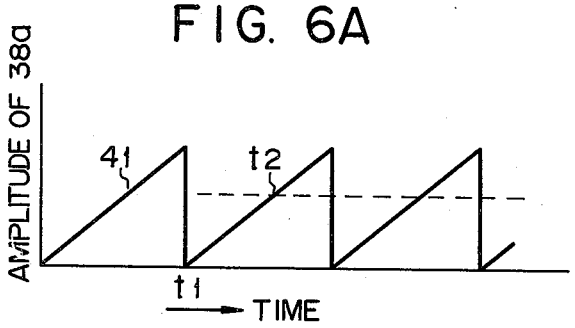
Figure 6B:
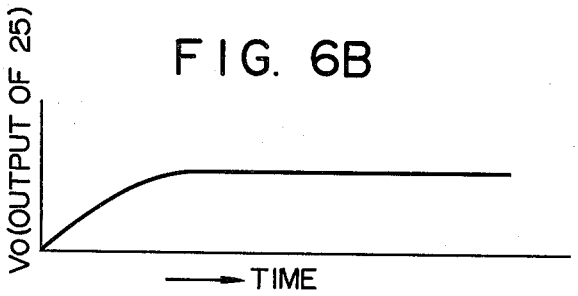
Figure 6C:
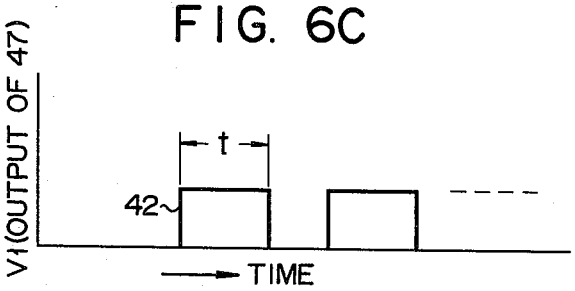
Figure 7A:
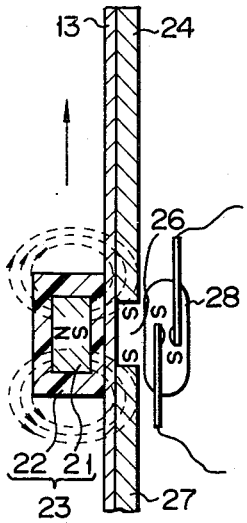
Figure 7B:
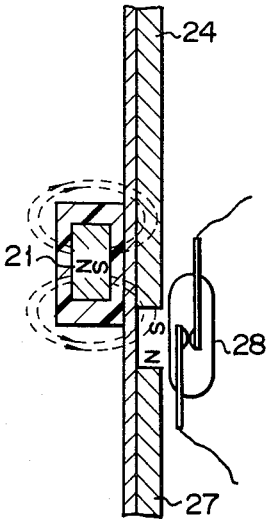
Figure 7C:
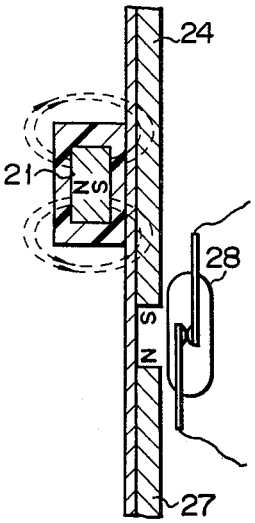
Figure 8A:
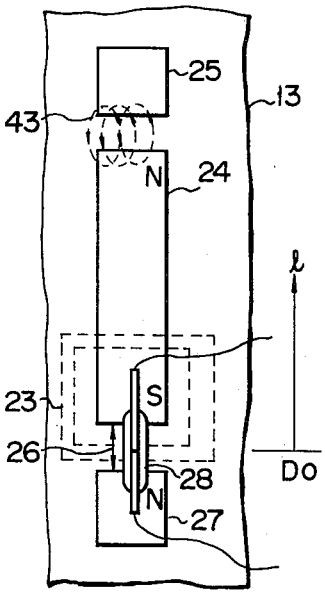
Figure 8B:
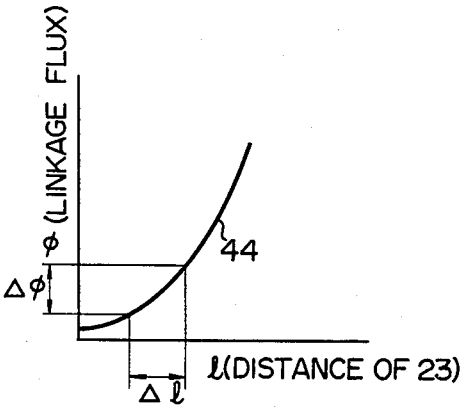
Figure 11A:
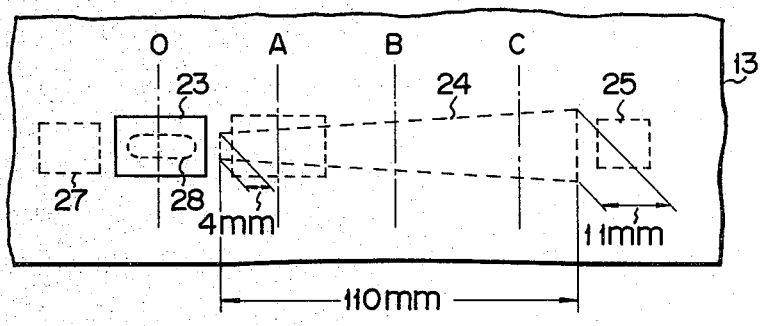
Figure 11B:
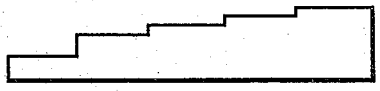
Figure 11C:
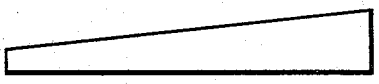
Figure 11D:
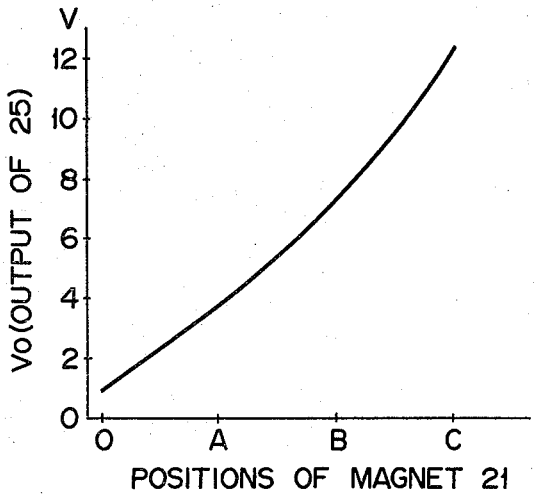
Figure 12:
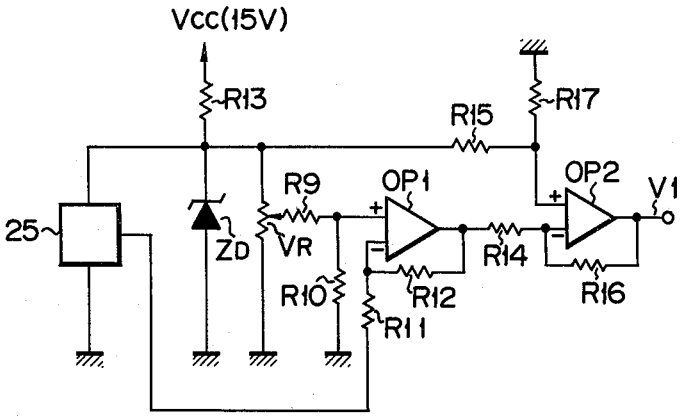
Figure 13:
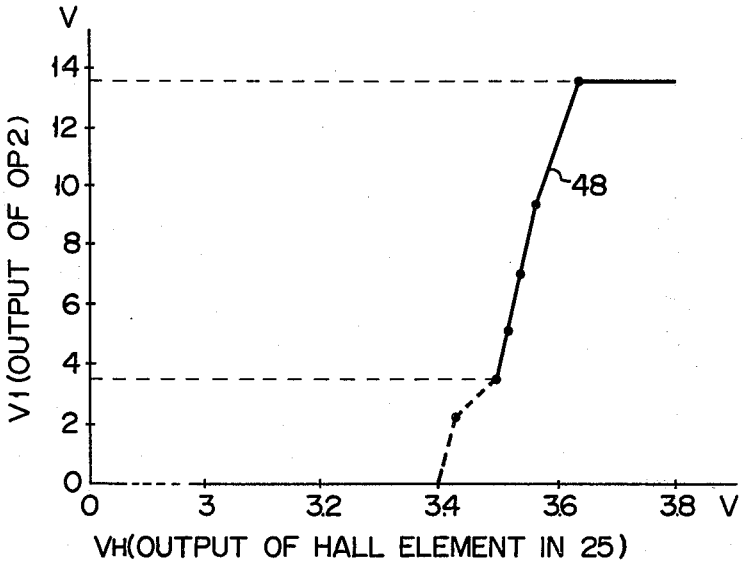
Figure 14A:
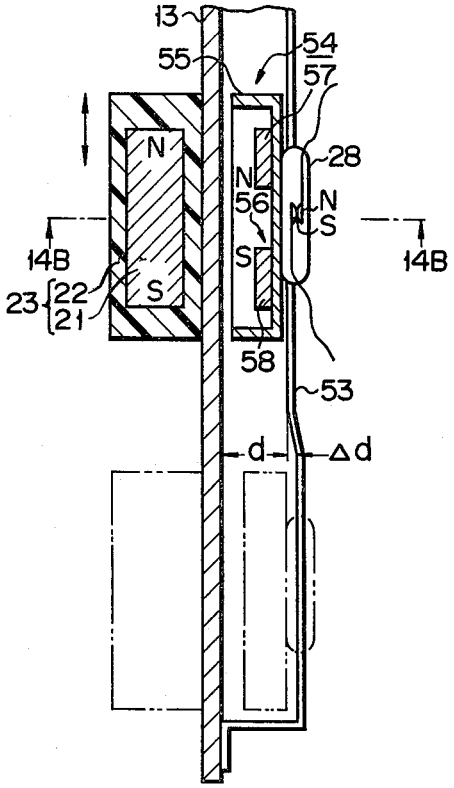
Figure 14B:
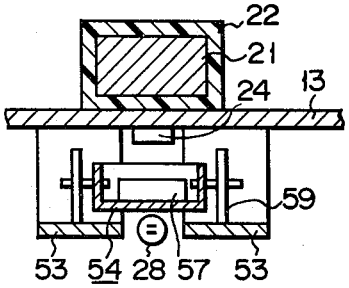
Figure 15:
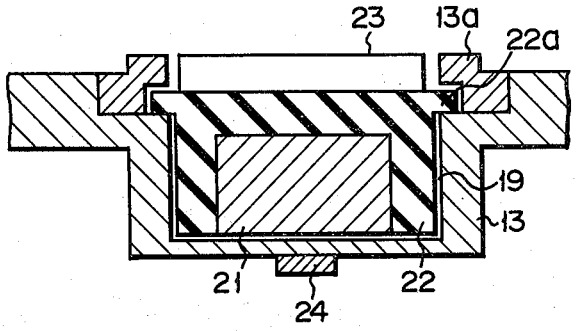
Figure 16:
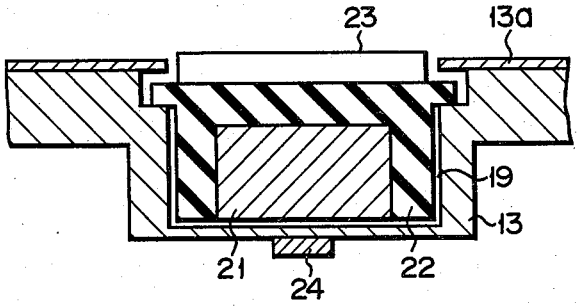

FIG. 5 graphically represents a relation between an output signal from a magnetic field detecting circuit and a distance of a knob measured from a reference position of the knob;

FIGS. 6A to 6C are waveforms for explaining the operation of the circuit arrangement shown in FIG. 4;

FIGS. 7A to 7C are cross sectional views useful in explaining a sequence of operations of a reed switch shown in FIG. 3;

FIGS. 8A and 8B are diagrams useful in explaining the operation of the magnetic field detecting circuit shown in FIG. 4;

FIG. 9 is a modification of the oscillation output control means in an oscillation circuit;

FIGS. 10A to 10D show a set of waveforms for explaining the operation of the output control means shown in FIG. 9;

FIGS. 11A to 11C are modifications of the magnetic field adjusting plate;

FIG. 11D shows a relation between positions of the magnetic field generating element and an output of the magnetic field detecting circuit when the magnetic field adjusting plate shown in FIG. 11A is used;

FIG. 12 shows another modification of the oscillation output control means in the oscillation circuit;

FIG. 13 is a graphical representation useful in explaining the operation of part of the circuit shown in FIG. 12;

FIGS. 14A and 14B are cross sectional views of the ON-OFF controls of a reed switch shown in FIG. 3;

FIG. 15 shows an enlarged cross sectional view of a modification of the guide path for the magnetic field generating element; and FIG. 16 shows an enlarged cross sectional view of another modification of the guide path for the magnetic field generating element.

Figure 1:
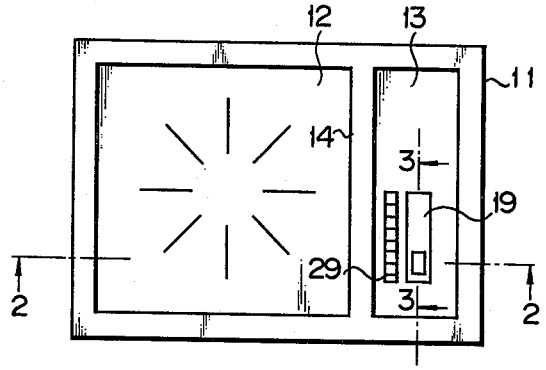
FIG. 1 shows a plan view of an embodiment of an induction heating cooking apparatus according to the present invention.
Figure 2:
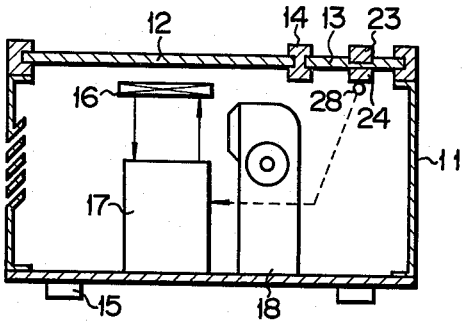
FIG. 2 shows a cross sectional view taken on line 2—2 in FIG. 1.

Referring to FIGS. 1 and 2, there is illustrated an embodiment of an induction heating cooking apparatus according to the invention. In the figures, provided at the top of a casing are a plate 12 made of nonmagnetic material such as glass or aluminium on which an induction heating cooking pan is placed and a plate 13 similarly made of nonmagnetic material. The nonmagnetic plate 12 will frequently be referred to as a first nonmagnetic plate, while the nonmagnetic plate 13 a second nonmagnetic plate or a control panel. The first and second nonmagnetic plates 12 and 13 are partitioned by means of a partitioning member 14. The casing 11 is supported by supporting members 15. An electric circuit 17 provided in the casing 11 contains an oscillation circuit with an induction heating coil 16 disposed close to the inner side of the first nonmagnetic plate 12, an electric circuit coupled between an external power source (not shown) and the oscillation circuit, and part of the oscillation output control means for controlling the output of the oscillation circuit, or the power supplied to the heating coil 16. The second nonmagnetic plate 13 is provided with parts for controlling the coupling of the external power source with the electric circuit 17 and parts for controlling the output from the oscillation circuit. If necessary, a cooling fan 18 is provided within the casing 11. The control parts will briefly be described referring to FIG. 3. In FIG. 3, a magnet 21 such as a permanent magnet is disposed in a groove 19 formed in the upper surface of the second nonmagnetic plate 13. The magnet 21 within the groove 19 is slidable in a direction of an arrow 20. The magnet 21 molded in a resin member 22 is used as a knob 23 for adjusting the output of the oscillation circuit. A magnetic field adjusting plate 24 made of an iron plate, for example, is fixedly disposed on the inner side of the second nonmagnetic plate 13 corresponding to the groove 19. A magnetic field detecting circuit 25, as integrated, containing a Hall element is mounted on the inner side at a position close to a first end of the magnetic field adjusting plate 24. A magnetic auxiliary plate 27 is further mounted on the inner side at a position close to but opposite to the second end of the magnetic field adjusting plate 24 with a gap 26 disposed therebetween. Under the gap 26, a reed switch 28 is arranged with its center being coincident with the center of the gap 26. The reeds of the reed switch 28 are led to the electric circuit or the drive circuit 17. An indicator 29 for indicating ON-OFF of the external power source and the output of the oscillation circuit is provided on the surface of the second nonmagnetic plate 13 in the printing manner, for example.

Turning to FIG. 4, there is shown examples of the drive circuit containing the oscillation circuit and the oscillation output control means. In FIG. 4, an AC power source 30 is connected to an input terminal of a rectifier 32 by way of a switch 31. The output terminal of the rectifier 32 is coupled with the oscillation circuit 33. An induction heating coil 16 forms a part of the oscillation circuit 33. An example of the oscillation circuit 33, which may be constructed by the conventional technique, is comprised of a transistor **33*a* connected between the output terminals of the rectifier 32 via the heating coil 16, a diode 33*b* connected across the emitter-collector circuit with the polarity as shown, a first capacitor 33*c* connected in parallel across the diode 33*b* and the transistor 33*a*, the induction heating coil 16 connected between the terminal of the first capacitor 33*c* which is connected to the collector of the transistor 33*a* and the positive output terminal of the rectifier 32, a second capacitor 33*d* connected across the outputs of the rectifier 32 and also used as a smoothing capacitor, and a pulse generating circuit 33*e* which is connected between an oscillation output control circuit 47 and the base of the transistor 33*a* and produces pulses of which the number corresponds to the pulse width of the output pulse from the oscillation output control circuit 47. The reed switch 28 is connected across a relay 36, through a DC power source 34 and a resistor 35. The relay 36 is related to the switch 31 such that it opens the power source switch 31 when the reed switch 28 is open and closes the switch 31 when the reed switch 28 is closed. The operational relation of the reed switch 28 with the power source switch 31, principally illustrated, may be modified variously by the usage of the conventional technique. When the adjusting knob 23 is at a position shown in FIG. 3, the reed switch 28 is in open state and therefore the power source switch 31 is in OFF state. When the knob 23 is moved to the right as viewed in the drawing, the reed switch 28 is turned on and the power source switch 31** is in ON state. This will be described in detail later referring to FIGS. 7A to 7C.

The magnetic field detecting circuit 25 comprises a Hall element **25*a* connected between a power source $V_{cc}$ and ground, an amplifier 25*b* for amplifying the output signal from the Hall element 25*a*, and an output stage amplifier 25*c* supplied with the output signal from the amplifier 25*b*. An oscillation output control circuit 47 for the oscillation circuit 33 is comprised of a reference signal generating circuit 38 for generating a reference signal 38*a* including a unijunction transistor UJT and an operational amplifier 39. The unijunction transistor UJT is connected between one end of a resistor $R_2$ of which the other end is grounded and one end of a resistor $R_1$ of which the other end is connected to the power source $V_{cc}$, and to the connection point between one end of a resistor $R_3$ of which the other end is connected to the power source $V_{cc}$ and one end of a capacitor $C_1$ of which the other end is grounded. The output signal $V_0$ of the magnetic field detecting circuit 25 is applied through a resistor $R_4$ to the positive input terminal of the operational amplifier circuit 39. The output signal 38*a* of the reference signal generating circuit 38 is applied through a resistor $R_5$ to the negative input terminal of the operational amplifier circuit 39. The output voltage $V_1$ of the operational amplifier circuit 39 is applied to a pulse generating circuit 33*e* of the oscillation circuit 33**.

The operation of the induction heating cooking apparatus thus constructed will be described referring to FIG. 3. As will be described later referring to FIG. 7A, the reed switch 28 is in open state when the adjusting knob 23 is at a position shown in FIG. 3. At this time, the power source switch 31 shown in FIG. 4 is in open state, so that the oscillation circuit 33 is inoperative. When the knob 23 is moved to the right as viewed in FIG. 3, the reed switch 28 is in close state, as shown in FIGS. 7B and 7C. Therefore, the power source switch 31 is closed and the oscillation circuit 33 is conditioned for its oscillation. As will be described referring to FIGS. 8A and 8B, as the knob 23 shown in FIG. 3 is moved to the right, the magnetic flux $\phi$ interlinking with the Hall element (contained in the magnetic field detecting circuit 25) via the magnetic field adjusting plate 24 increases. Therefore, the output signal $V_0$ (FIG. 4) from the magnetic field detecting circuit 25 increases. For graphical representation, a distance l of the knob 23 moved from a reference point as a midpoint Do of the gap 26 is scaled along the abscissa, while the output voltage $V_0$ of the magnetic field detecting circuit 25 along the ordinate. The result is a graphical representation of an $l-V_0$ relation 40 shown in FIG. 5. The reference signal generating circuit 38 (FIG. 4) produces a reference signal 38*a* as a sawtooth wave 41 of which the period is determined by the capacitance of the capacitor $C_1$, as shown in FIG 6A. On the other hand, when the knob 23 is moved to the right from the reference point Do (FIG. 3) and is positioned at a location distanced from the reference point Do, the output voltage $V_0$ from the magnetic detecting circuit 25 changes with respect to time, as shown in FIG. 6B. When a sawtooth waveform 41 shown in FIG. 6A (generally denoted as the reference signal 38*a*) and the waveform of the output voltage $V_0$ shown in FIG. 6B are applied to the operational amplifier 39 (FIG. 4), the output voltage $V_1$ as shown in FIG. 6C is obtained. The pulse width of each pulse of the output voltage $V_1$ from the operational amplifier circuit 39 is expressed by the time period from a time point $t_1$ when the sawtooth wave rises to a cross point $t_2$ of the sawtooth wave to the output voltage $V_0$. Therefore, when the amplitude of the output $V_0$ is small, the pulse width t is small, the former is large, the latter is large. The pulse generator 33*e* of the oscillation circuit 33 produces pulses of which the number corresponds to the pulse width 5 of the output voltage $V_0$. The induction heating coil 16 of the oscillation circuit 33 allows high frequency current of a frequency corresponding to the number of the pulses from the pulse generating circuit 33*e* to flow therethrough. In other words, the oscillation circuit 33 oscillates during a period of time corresponding to the pulse width of the pulse 42 shown in FIG. 6C. Although such an oscillation circuit is well known, it will be described briefly for each of understanding of the invention.

When the first pulse is applied from the pulse generating circuit 33*e* to the base of the transistor 33*a*, the transistor 33*a* conducts to allow current to flow $i_1$ (approximately $\frac{1}{4}$ cycle) to flow in the direction of 16*a*. When the first pulse terminates, the transistor 33*a* is turned off to allow current $i_2$ to flow into the capacitor 33*c* in the direction of 16*a*. The current $i_2$ is approximately $\frac{1}{4}$ cycle. When the capacitor 33*c* is fully charged, the capacitor 33*c* and the heating coil 16 resonate with each other and in inverse current $i_3$ (approximately $\frac{1}{4}$ cycle) flow in the direction of 16*b*. The charge stored in the capacitor 33*c* is discharged by a current $i_4$ flowing in the direction 16*b* through a route including the capacitor 33*d*, the diode 33*b* and the coil 16. Thus, high frequency current ($i_1+i_2+i_3+i_4$) of one cycle flows into the coil 16 by the first pulse produced from the pulse generating circuit 33*e*. The same thing is true for the second, third, . . . pulses of the pulse generating circuit 33*e*. Accordingly, the high frequency current of the number of cycles corresponding to the width t of the pulse 42 shown in FIG. 6C. In other words, the oscillation output from the oscillation circuit 33 may be controlled in accordance with the output voltage $V_0$ shown in FIG. 6B.

The explanation to follow is for the on-off control of the reed switch 28. Reference is made to FIGS. 7A to 7C. At a position of the knob 23 shown in FIG. 7A, the reed switch 28 is off. At this time, the center of the gap 26 coincides with the center of the reed switch 28. The polarity of the magnet 21 is assumed to be as shown in the figure. On this assumption, the end faces of the magnetic field adjusting plate 24 and the auxiliary plate 27, which faces the reed switch, are of the S polarity and the contacts of the reed poles of the reed switch 28 are both of the S polarity. Therefore, the reed switch 28 is in open state. Even when the polarity of the magnet 21 is opposite to that shown in the figure, the end faces of the reed poles which face each other are of the same polarity and the reed switch 28 is in open state. When the knob 23 is moved to the position shown in FIGS. 7B and 7C, the end face of the reed switch of the magnetic field adjusting plate 24, facing the reed switch, is still of the S polarity, while the end face of the auxiliary plate 27 is of the N polarity. Therefore, the contact faces of the reed poles of the reed switch 28 have different polarities, respectively, so that the reed switch becomes close.

Turning now to FIGS. 8A and 8B, there are shown a relation between a magnetic flux $\phi$ interlinking with the Hall element 25*a* (FIG. 4) contained in the magnetic field detecting circuit 25 and a movement distance l of the adjusting knob 23 from the reference point Do. As shown in FIG. 8A, the Hall element 25*a* (FIG. 4) contained in the magnetic field detecting circuit 25 crosses a magnetic flux 43 developed from the first end of the magnetic field adjusting plate 24. A relation between the distance l and the linkage flux 43 is plotted by a curve 44 shown in FIG. 8B. When the distance l changes by $\Delta l$ the linkage flux $\phi$ changes by $\Delta\phi$.

The combination of the magnetic field detecting circuit 25 and the oscillation output control circuit 47, as shown in FIG. 4, may be modified into a circuit shown in FIG. 9. As shown, the output voltage $V_0$ from the magnetic field detecting circuit 25 including the Hall element 25*a* is amplified by a transistor 50 and the amplified output is applied to the positive input terminal of the operational amplifier circuit 39, through a resistor $R_7$. The sawtooth wave reference signal 38*a* derived from the same circuit as the reference signal generating circuit 38 shown in FIG. 4 is applied to the negative input terminal of the operational amplifier circuit 38 shown in FIG. 4. The capacitor $C_2$ is connected between the positive input terminal and the negative input terminal. The output voltage $V_1$ from the operational amplifier circuit 39 is applied to the oscillation circuit 33. As shown in FIGS. 8A and 8B, when the knob 23 is moved in the direction l, the linkage flux 43 interlinking with the Hall element 25*a* (contained in the magnetic flux detecting circuit 25) may be increased. If the knob 23 is moved through three steps, the output signal from the magnetic flux detecting circuit 25 may be changed by three steps 50*a*, 50*b* and 50*c*, as shown in FIG. 10A. The UJT oscillator or the reference signal generating circuit 38 produces sawtooth wave signals 38*a*1, 38*a*2, 38*a*3, . . . with a fixed period, as shown in FIG. 10B. The transistor 50 amplifies the output voltage $V_0$ and applies amplified signals 50*a*1, 50*b*1, 50*c*1, . . . shown in FIG. 10C to the positive terminal of the operational amplifier circuit 39*a*, via a resistor $R_7$. Therefore, pulses having pulse widths 42*a*, 42*b* and 42*c* are obtained as the output voltage $V_1$ from the operational amplifier circuit 39*a*. In this way, since the pulse width of the output voltage $V_1$ from the operational amplifier circuit 39*a* changes in accordance with the position of the knob 23, the output of the induction heating coil 16 shown in FIG. 3 changes.

When the cross sectional area of the magnetic field adjusting plate 24 is fixed with respect to the length l, the number of the linkage flux $\phi$ for the Hall element sometimes does not change with a range of the positions of the knob 23. The magnetic flux density B of the magnetic field adjusting plate 24 is expressed by $\phi/S$, i.e., $B=\phi/S$, where $\phi$ is flux passing through the magnetic field adjusting plate 24 and S, a cross sectional area of the magnetic field adjusting plate 24. The intensity of the magnetic field is expressed by $H=B/\mu$ where $\mu$ is a constant. The intensity $H_0$ of the magnetic field at a point distanced by r from a magnetic pole with a magnetic charge m is expressed by $H=Km/r^2$ where K is a constant. As seen from the above, when the cross section area of the magnetic field adjusting plate 24 is small, the magnetic flux $\phi$ is small, and when the distance r is large, the magnetic field is weak. Therefore, if the cross sectional area of the magnetic field adjusting plate 24 is gradually increased toward the Hall element, the output signal from the Hall element may be changed substantially linearly with respect to the moving distance l of the knob 23. For example, the width of the magnetic field adjusting plate 24 which faces the reed switch 28 was 4 mm, that facing the magnetic field detecting circuit 25 was 11 mm, and the length thereof was 110 mm. Under this condition, the output voltage $V_0$ of the magnetic field detecting circuit 25 could be changed substantially linearly from 4 V to 12 V, as shown in FIG. 11D. In FIG. 10D, symbols O, A, B and C arranged on the abscissa are positions of the knob 23 as shown in FIG. 11A.

FIG. 12 shows an additional modification of the combination of the magnetic field detecting circuit 25 and the oscillation output control circuit 47 shown in FIG. 4. We had a characteristic shown in FIG. 13 by applying the magnetic field detecting circuit 25 shown in FIG. 11D to the circuit shown in FIG. 12. In a graph shown in FID. 13, the output voltage $V_H$ of the Hall element 25*a* contained in the magnetic field detecting circuit 25 is taken along the abscissa while the output voltage $V_1$ of the operational amplifier circuit $OP_2$ shown in FIG. 12 is taken along the ordinate. In a curve 48, a range of the output voltage $V_1$ from approximately 3.5 V to 13.5 V is practically used. In FIG. 12, the output voltage from the magnetic detecting circuit 25 is applied to the negative input terminal of a first operational amplifier $OP_1$, by way of a resistor $R_{11}$. For obtaining a fixed voltage, a Zener diode $Z_D$ is connected to the power source $V_{cc}$ through a resistor $R_{13}$ thereby to apply a constant voltage across a resistor $V_R$. The constant voltage obtained by voltage-division through the resistor $V_R$ is applied as a reference signal to the positive input terminal of the first operational amplifier circuit $OP_1$, through a resistor $R_9$. The output voltage of the first operational amplifier circuit $OP_1$ is applied through a resistor $R_{14}$ to the negative input terminal of the second operational amplifier $OP_2$. The positive input terminal of the second operational amplifier $OP_2$ is grounded throgh a resistor $R_{17}$, while being supplied with a reference voltage of the constant voltage across the Zener diode $Z_D$ through a resistor $R_{15}$. The output voltage $V_1$ is applied to the oscillation control circuit 33.

The cross sectional area of the magnetic field adjusting plate 24 may stepwisely be changed as shown in FIG. 11B, or may be smoothly be changed at a fixed rate, being shaped like a trapezoid, as shown in FIG. 11C.

The on-off control of the reed switch 28 may be performed as shown in FIGS. 14A and 14B. As shown in FIG. 14A, a knob 23 in which a magnet 21 with S and N poles is moulded in a resin member 22 is disposed on the upper surface of the second nonmagnetic plate 13. A coupled of rails or guide members 53 extending in the direction of the knob 23 movement is fixed to inner surface of the second nonmagnetic plate 13. The distance between the upper surface of the rail 53 and the inner surface of the second nonmagnetic plate 13 is (d $+\Delta$d) at a location where the knob 23 is positioned as indicated by a two-dot chain line, and is d at a location where the knob 23 is positioned as indicated by a real line. Disposed between the rail 53 and the second nonmagnetic plate 13 is a moving structure 54 moving following the movement of the knob 23. The moving structure 54 is provided with a frame member 55 in which magnetic members 57 and 58, e.g. iron plates, are disposed on the bottom surface of the frame member 55 spaced by a gap 56. A reed switch 28 is fixed to the outer side of the bottom member of the frame member 55 at a location facing the gap 56. Four rolls 59 are rotatably mounted on the side wall of the frame member 55. With this arrangement, the frame member 55, the iron plates 57 and 58 and the reed switch 28 travel on the rail 53, following the movement of the knob 23. When the knob 23 is located at the position as indicated by a two-dot chain line shown in FIG. 14A, the magnet 21 provides insufficient magnetic field to the reed switch, so that the reed switch 28 is in open state. However, when the knob 23 is moved to a position as indicated by the real line in the figure, the reed switch 28 approaches to the knob 23 by $\Delta$d. At this time, different polarities appear at the end surfaces of the reed poles of the reed switch 28, resulting in close state of the reed switch. According to the method, so long as the reed switch 28 is at the close position, that is, the oscillation circuit 33 is at the operable position, the chattering of the reed switch 28 may be prevented since a magnetic field with a fixed intensity is applied from the magnet 21 to the contact of the reed switch 28. Further, reduction of the pressure applied to the contacts of the reed switch may also be prevented. The result is a stable operation of the reed switch. Additionally, because of the simple structure, the device is almost free from trouble. By removing the knob 23 from the second nonmagnetic plate 13, the reed switch 28 is turned off thereby to surely turn off the power source 30.

The example shown in FIG. 3 is the one in which the adjusting knob 23 contaning the magnetic field generating element such as the permanent magnet 21 may easily be removed from the groove 19. Some use, however, refuses the easy removal of the knob 23 from the groove 19. Examples of such a case are illustrated in FIGS. 15 and 16. These figures illustrate cross sections taken on line 2—2 in FIG. 1. In FIG. 15, the convex portion of the adjusting knob 23 is fitted into the groove 19 of the second nonmagnetic plate 13. The resin member 22 of the adjusting knob 23 has a projection 22*a*. Two knob holding members 13*a* are fixed to two opening sides of the groove so as to cover the projections 22*a*. With this arrangement, the adjusting knob 23 is never slipped off the groove 19. The example shown in FIG. 16 has the knob holding member 13*a* fixed along the upper surface of the second nonmagnetic plate 13.

Although the first and second nonmagnetic plates 12 and 13 are separately provided in the example shown in FIG. 1, when those are formed with a single member with the same material, the assembling work of the device is simplified. The moulding of the magnet 21 by resin is not essential. In the case of the device with the structure allowing the removal of the knob, the cleaning of the top plate is very easy. Since the turning on the power source switch and the temperature adjustment of the cooking pan are possible on the second nonmagnetic plate 13, the operation of the cooking apparatus is easy.

Further, the characteristic of the oscillation output to the knob position may be changed desirably.

What is claimed is:

1. An induction heating cooking apparatus comprising a housing with a top plate section including a first nonmagnetic portion on which an induction heating pan is placed and a second nonmagnetic portion for controlling the induction heating of the cooking pan; a drive circuit with an oscillation circuit including an induction heating coil for heating said cooking pan, which is contained in said housing for being connected to an external power source; and oscillation output control means for controlling the oscillation output of said oscillation circuit; wherein said oscillation output control means comprises:

a magnetic field generating element slidable along a guide path formed on the surface of said second portion of said top plate section;

a magnetic field adjusting plate made of a magnetic material and provided on the inner side corresponding to said guide path of said second portion of said top plate section;

a magnetic field detecting circuit which is provided close to a first end of said magnetic field adjusting plate and includes a semiconductor element for producing an output signal corresponding to an intensity of a magnetic field developed from said magnetic field generating element; and an oscillation output control circuit which compares the output signal from said magnetic field detecting circuit with a reference signal produced from a reference signal generating circuit.

2. An induction heating cooking apparatus according to claim 1, wherein said guide path is a groove formed in the surface of said second portion of said top plate section.

3. An induction heating cooking apparatus according to claim 1, wherein said first and second portions on said top plate section are integrally made of the same material.

4. An induction heating cooking apparatus according to claim 1, wherein said magnetic field generating element is a permanent magnet moulded by resin member.

5. An induction heating cooking apparatus according to claim 1, wherein the cross section of said magnetic field adjusting plate increases from a second end of said magnetic field adjusting plate to a first end.

6. An induction heating cooking apparatus according to claim 1, wherein said magnetic field detecting circuit includes a Hall element which produces an output signal changing in accordance with the intensity of a magnetic field developed from said magnetic field generating element.

7. An induction heating cooking apparatus according to claim 1, wherein said guide path is a groove formed in the surface of said second portion of said top plate section, and a member is provided for preventing said magnetic field generating element from slipping out of said groove.

8. An induction heating cooking apparatus according to claim 1, wherein said oscillation output control circuit includes a sawtooth wave oscillation circuit for producing a reference signal as a sawtooth wave and an operational amplifier circuit, and said operational amplifier circuit receives at the first input terminal an output signal from said magnetic field detecting circuit and at the second input terminal an output signal from said sawtooth wave oscillation circuit, and produces a pulse voltage with a width corresponding to a period where the level of said second input signal is lower than said first input signal level as an oscillation output control signal for said oscillation circuit.

9. An induction heating cooking apparatus according to claim 1, wherein said oscillation output control means further comprises means for turning on and off an external power source for controlling an electrical coupling between said external power source and said drive circuit in accordance with a position of said magnetic field generating element, said external power source on-off means comprising an auxiliary magnetic plate disposed in opposition to a second end of said magnetic field adjusting plate via an air gap; and switch means disposed under said air gap of which the on-off operation is controlled in accordance with a position of said magnetic field generating element and which controls the electrical coupling of said external power source with said drive circuit.

10. An induction heating cooking apparatus according to claim 1, wherein said oscillation output control means further comprises:

means for turning on and off an external power source for controlling an electrical coupling between said external power source and said drive circuit in accordance with a position of said magnetic field generating element;

said external power source on-off means comprising a pair of guide members having a first and second parts which extend in parallel with said guide path along the inner surface of said second portion of said top plate section, said first part having a first distance from said inner surface and said second part having a second distance shorter than said first distance, and a moving structure which is moved on said guide members, following the movement of said magnetic field generating element; and said moving structure having first and second magnetic members successively disposed with a given gap therebetween in the direction of said guide path and switch means fixed under said gap, said switch means being turned off when said moving structure is moved onto said first part of said guide members and being turned on by the magnetic field from said magnetic field generating element when said moving structure is moved onto said second part of said guide members, thereby to control the electrical coupling between said external power source and said drive circuit.

11. An induction heating cooking apparatus according to claim 9 or 10, wherein said switch means includes a reed switch.

12. An induction heating cooking apparatus according to claim 1, wherein said reference signalgenerating circuit generates a sawtooth wave signal of a fixed frequency as said reference signal.

* * * * *